United States Patent [19]

West

[11] Patent Number: 4,936,569

[45] Date of Patent: Jun. 26, 1990

[54] CAROUSEL APPARATUS

[76] Inventor: Rodney G. West, 5581 S. Jamaica Way, Englewood, Colo. 80111

[21] Appl. No.: 361,997

[22] Filed: Jun. 5, 1989

[51] Int. Cl.[5] ..... A63G 1/12

[52] U.S. Cl. ..... 272/30; 272/28 R; 272/33 R

[58] Field of Search ..... 272/28 R, 28 S, 33 R, 272/39, 41, 54, 30

[56] References Cited

U.S. PATENT DOCUMENTS

| | | | |
|---|---|---|---|
| 1,514,316 | 11/1924 | Hardy | 272/30 |
| 1,669,063 | 5/1928 | Mills | 272/33 R |
| 1,736,678 | 11/1929 | Thornton | 272/33 R |
| 1,739,725 | 12/1929 | Lamar | 272/33 R |
| 3,390,879 | 7/1968 | French | 272/54 |
| 3,599,973 | 8/1971 | Ahrens | 272/30 |
| 3,858,871 | 1/1975 | Bourne | 272/30 |

*Primary Examiner*—Richard E. Chilcot, Jr.

*Attorney, Agent, or Firm*—Leon Gilden

[57] ABSTRACT

A carousal apparatus is set forth wherein a ground supported base integrally secures a first post extending upwardly thereof with a second post telescopingly secured thereover. The second post telescopingly receives at an upper end thereof a third post rotatably mounted therein with a cap member overlying the second post to sandwich the second post between the third post and cap member to rotatably mount the third post therein. A flange plate is orthogonally secured to the third post receiving four downwardly extending support rods. The support rods are positioned through the flange plate and welded thereto in a quadrangular orthogonally oriented relationship to enhance integrity of the organization. A non-skid support plate is secured to the support rods where individuals may stand upon the support plate and simultaneously grasp the support rods during a spinning event.

8 Claims, 4 Drawing Sheets

CAROUSEL APPARATUS

BACKGROUND OF THE INVENTION

1. Field of the Invention

The field of invention relates to amusement devices, and more particularly pertains to a new and improved carousel apparatus wherein the same compactly and integrally secures a carousel support plate relative to support posts.

2. Description of the Prior Art

The use of carousel-type apparatus is well known in the prior art. As may be appreciated, these devices typically require a substantial amount of space and such, it is desirable to configure and arrange such apparatus into a compact, yet secure, organization to maintain safety of individuals utilizing such devices. In this connection, there have been several attempts to develop carousel apparatus which is securely and efficiently positioned relative to a plurality of users. For example, U.S. Pat. No. 1,514,316 to Hardy sets forth an amusement device wherein a vertical post supports a plurality of opposed seating arrangements where individuals, such as children, may be seated within the apparatus for use as an amusement. The Hardy patent is of interest relative to a single post support apparatus, but fails to set forth the compact organization of the instant invention wherein the Hardy patent requires relative balance between the individuals utilizing the device.

U.S. Pat. No. 1,739,725 to Lamar sets forth a merry-go-round wherein a vertical post includes a plurality of downwardly extending support rods which secure underlying "L" shaped members which in turn secure a pedestal support of multiple element construction. The Lamar patent utilizes a complexity of elements, as opposed to the instant invention which limits hazardous protrusions and effects a compact organization.

U.S. Pat. No. 3,390,879 to French sets forth a teeter board supported by an upwardly extending ground secured post. The French patent is of relatively remote organization, but is of interest relative to the balancing of an amusement device from a single ground supported post.

U.S. Pat. No. 3,858,871 to Bourne sets forth a carousel wherein a plurality of concentric rings secured about a central post support a variety of pairs of amusement devices. The Bourne device is typical of the prior art involving a complexity of elements, as opposed to the instant invention.

U.S. Pat. No. 3,599,973 to Ahrems sets forth a play ground swing apparatus utilizing a central post supporting a horizontal beam. A plurality of opposed swings are supported by the beam and may be tilted relative to one another. The Ahrems patent is cited to note further examples of ground-supported post apparatus.

As such, it may be appreciated that there is a continuing need for a new and improved carousel apparatus which addresses both the problems of compactness and strength of organization and in this respect, the present invention substantially fulfills this need.

SUMMARY OF THE INVENTION

In view of the foregoing disadvantages inherent in the known types of carousel apparatus now present in the prior art, the present invention provides a carousel apparatus wherein the same utilizes a horizontal support plate mounted exteriorly of support rods integrally securing the support plate to an overlying flange plate to provide a compact organization during periods of use. As such, the general purpose of the present invention, which will be described subsequently in greater detail, is to provide a new and improved carousel apparatus which has all the advantages of the prior art carousel apparatus and none of the disadvantages.

To attain this, the present invention comprises a centrally mounted orthogonally extending first post extending upwardly from a ground supported plate including a telescopingly overlying second post mounted to the first post. A third support post positioned interiorly of the second support post is rotatably mounted relative thereto and supports an overlying flange plate wherein a quadrangular organization of support rods extend downwardly therefrom to underlie a horizontal support plate for support of individuals thereon.

My invention resides not in any one of these features per se, but rather in the particular combination of all of them herein disclosed and claimed and it is distinguished from the prior art in this particular combination of all of its structures for the functions specified.

There has thus been outlined, rather broadly the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved carousel apparatus which has all the advantages of the prior art carousel apparatus and none of the disadvantages.

It is another object of the present invention to provide a new and improved carousel apparatus which may be easily and efficiently manufactured and marketed.

It is a further object of the present invention to provide a new and improved carousel apparatus which is of a durable and reliable construction.

An even further object of the present invention is to provide a new and improved carousel apparatus which is susceptible of a low cost of manufacture with regard to both materials and labor, and which accordingly is then susceptible of low prices of sale to the consuming public, thereby making such carousel apparatus economically available to the buying public.

Still yet another object of the present invention is to provide a new and improved carousel apparatus which provides in the apparatuses and methods of the prior art some of the advantages thereof, while simultaneously overcoming some of the disadvantages normally associated therewith.

Still another object of the present invention is to provide a new and improved carousel apparatus wherein the same utilizes an overlying flange plate to individually secure downwardly depending support rods which underlie a support plate for rotatably mounting the support plate relative to a central support column of support posts.

These together with other objects of the invention, along with the various features of novelty which characterize the invention, are pointed out with particularlity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
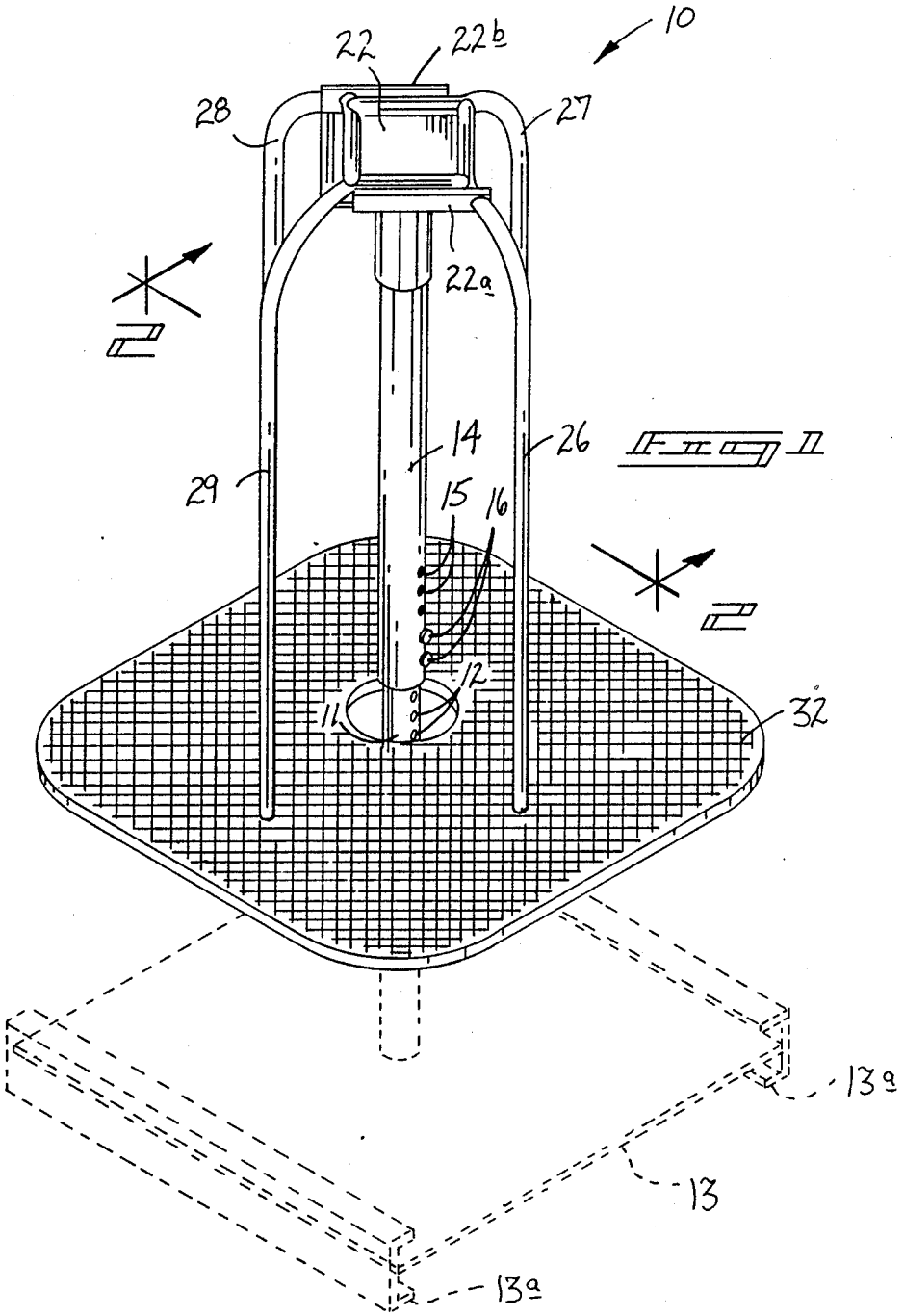
FIG. 1 is an isometric illustration of the instant invention.
Figure 2:
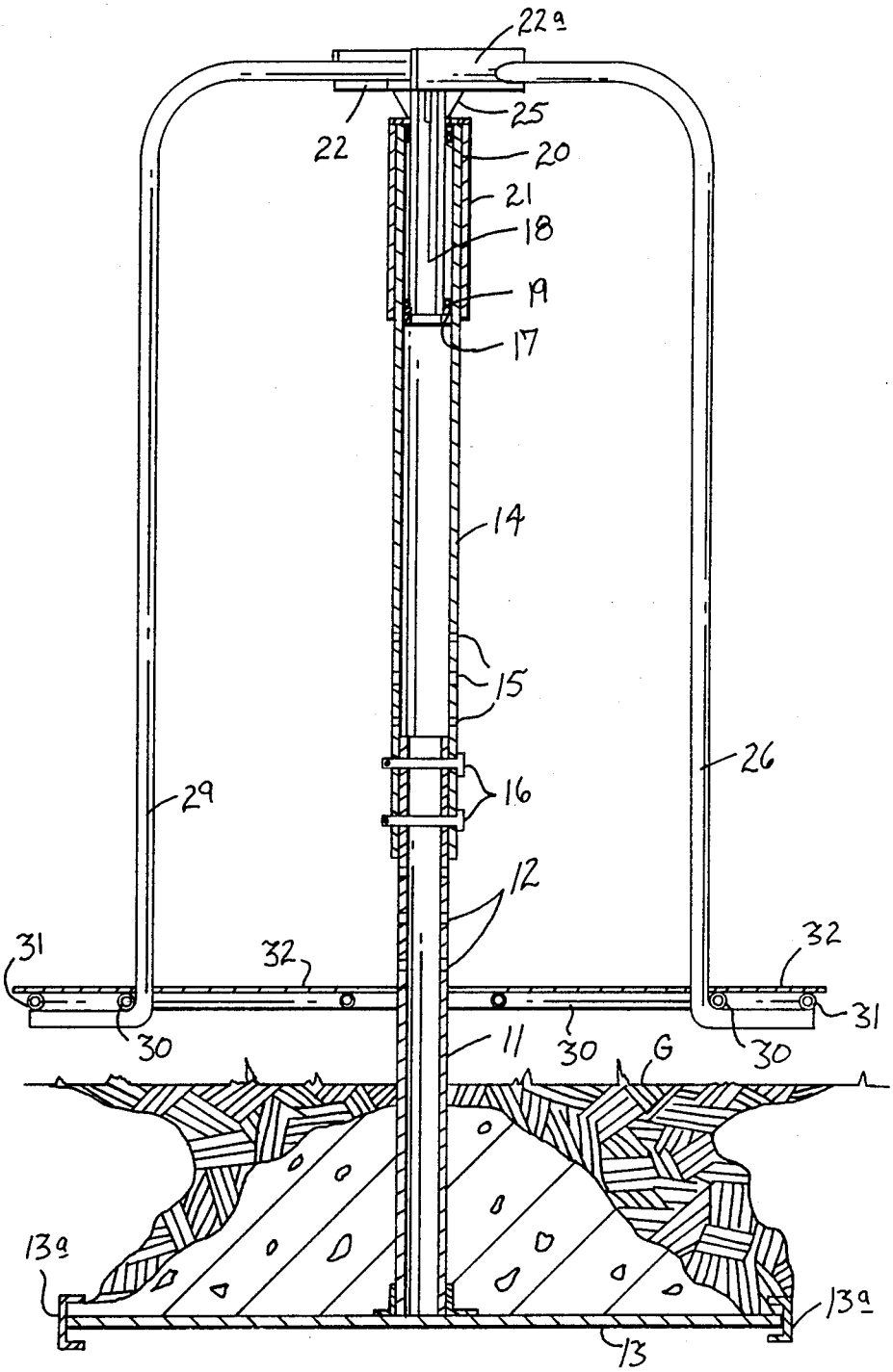
FIG. 2 is an orthographic view taken along the lines 2—2 of FIG. 1 in the direction indicated by the arrows.
Figure 3:
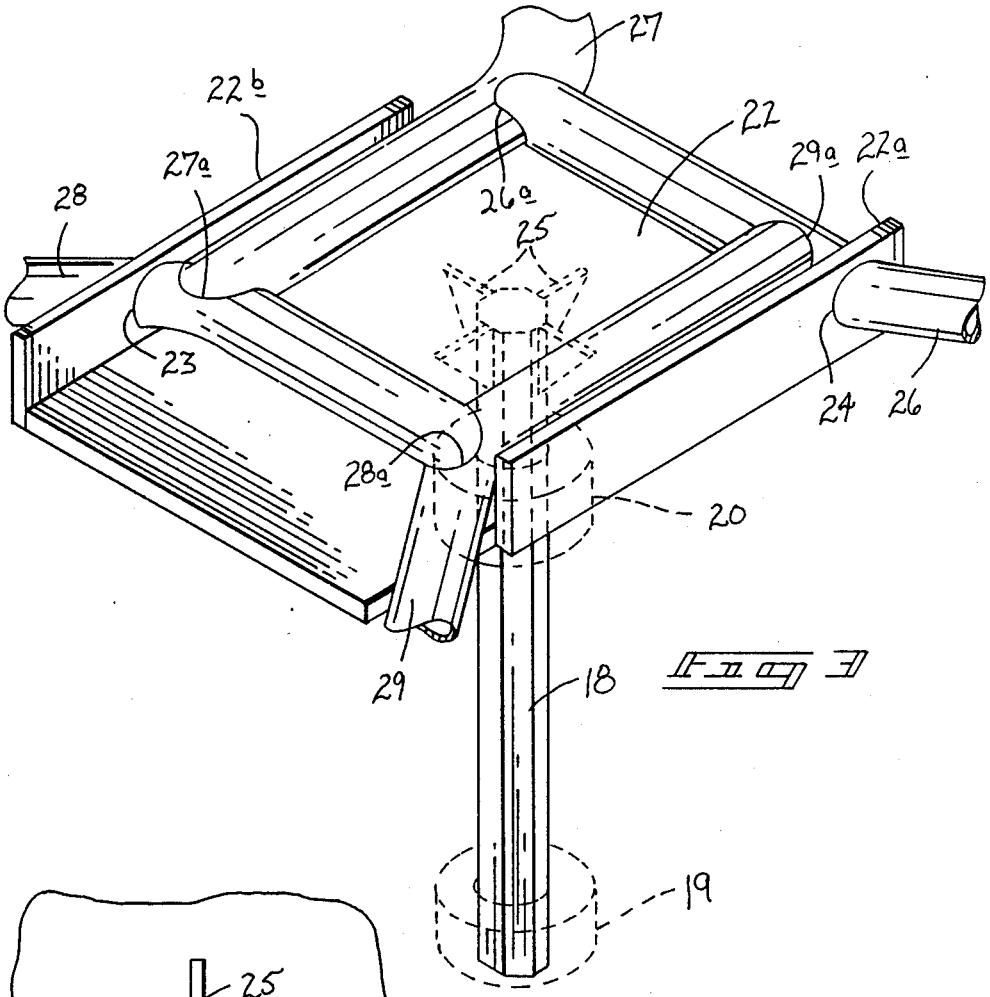
FIG. 3 is an isometric illustration, somewhat expanded, of the third support post of the instant invention.
Figure 4:
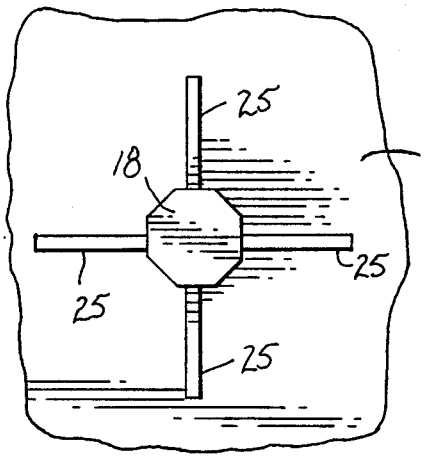
FIG. 4 is an orthographic bottom view of the third support post of the instant invention.

With reference now to the drawings, and in particular to FIGS. 1 to 6 thereof, a new and improved carousel apparatus embodying the principles and concepts of the present invention and generally designated by the reference numeral 10 will be described.

More specifically, it will be noted that the carousel apparatus 10 essentially comprises a first hollow post 11 including a plurality of aligned first apertures wherein first apertures include diametrically aligned openings through the wall of the first hollow post 11. The post 11 is orthogonally and integrally secured to an anchor plate 13 normally positioned below surface level of the supporting ground surface "G". The anchor plate 13 includes a plurality of opposed "C" channels 13*a* positioned at opposed ends of the anchor plate to prevent and minimize rocking and misalignment of the apparatus 10 when positioned within the ground "G". A second post 14 telescopingly receives the first post 11 and includes a series of second apertures 15 aligned and spaced equal to that of the first apertures 12 wherein the apertures 12 and 15 receive a plurality of securement pins 16 to selectively position the second post 14 at a vertical orientation relative to the first post 11.

A lower annular flange 17 is positioned interiorly of the second post 14 for receiving a lower bearing 19 of a third hexagonal post 18 received within the second post 14 at an upper end thereof. An upper bearing 20 is positioned at a remote upper portion of the third hexagonal post 18 to rotatably mount the third post 18 within the second post 14. A cap member 21 is positioned at a diameter greater than that of the second post 14 to overlie the second post 14 when the third post 18 and associated bearings are received within the second post 14 to provide protection to the bearings and prevent debris from entering the bearings, as well as with entering the interior of the first post 11 and second post 14. A square flange plate 22 is horizontally and integrally secured to an upper terminal end of the third post 18 and is provided with opposed flanges, including a first flange 22*a* and a second flange 22*b*. The first flange 22*a* is formed with a through-extending first opening 23 adjacent a vertical edge of the first flange 22*a* with a second opening 24 formed adjacent a diametrically opposed vertical edge of the second flange 22*b*. The flange plate 22 is provided with a plurality of triangular gussets to effect stability between the flange 22 and the upper end of the third post 18.

Figure 5:
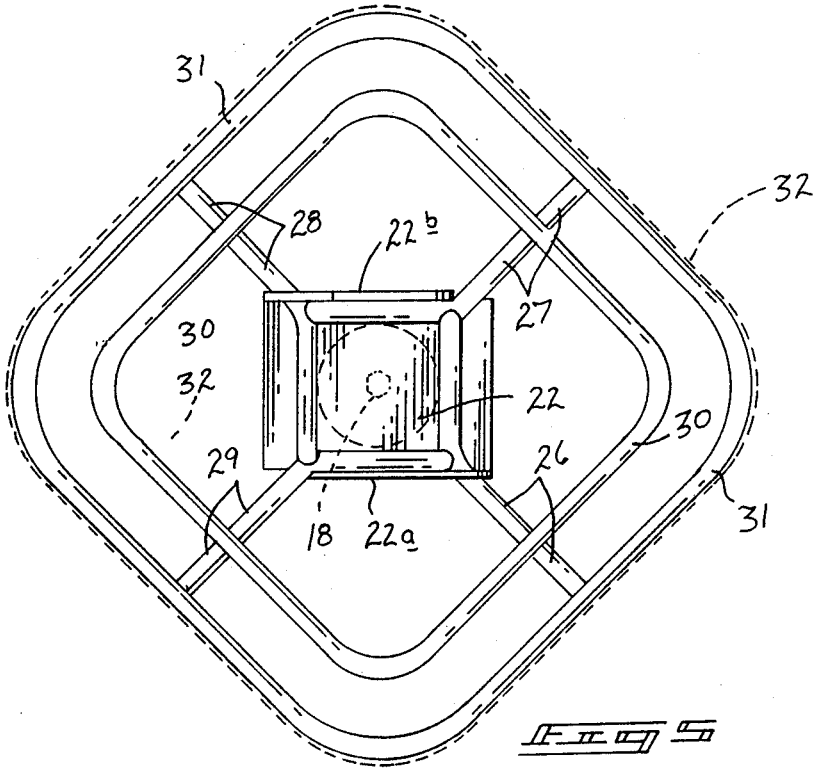
FIG. 5 is a top orthographic view of the instant invention.
Figure 6:
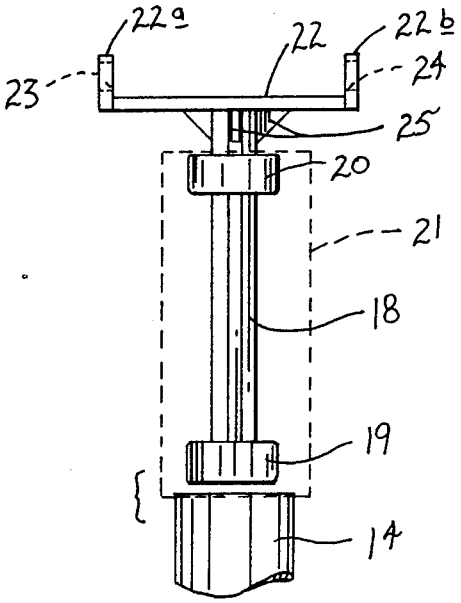
FIG. 6 is an orthographic view taken in elevation of the third support post extending in an exploded view exteriorly of the second support post.

A plurality of support rods including a first support rod 26, a second support rod 27, a third support rod 28, and a fourth support rod 29, of a generally "S" shaped configuration, each include inwardly extending ends secured through welding or the like to the upper surface of the flange plate 22. The first support rod 26 extends to the first opening 23 and aligned along a respective edge of the flange plate 22 wherein the second support rod 27 is received along the second flange 22*b* adjacent the first support rod 26 at a first concave recessed end 26*a* thereof, and wherein the second support rod 27 is formed with a second concave recessed end 27*a* to abut and receive within the recess the third support rod 28 received through the second opening 24 and lying along and aligned with a further edge of the flange plate 22 parallel to the first support rod 26. The third support rod 28 is formed with a third concave recessed end 28*a* to receive the fourth support rod 29 therewithin wherein the fourth support rod 29 is positioned adjacent the first flange 22*a* and is itself formed with a fourth concave recessed end 29*a* receiving the first support rod 26 therewithin. The organization when secured forms an integrally positioned and rigidly aligned apparatus to provide stability and compactness to the apparatus 10. Each of the support rods 26 through 29 are formed with a lowermost outwardly extending leg wherein the outwardly extending legs are positioned underlying an interior tubular rectangular frame 30 and an exterior tubular rectangular frame 31 horizontally aligned relative to one another to receive a non-skid plate 32 thereon. The non-skid plate 32 extends in a square configuration with rounded corners to minimize injury to individuals utilizing the apparatus from a position exteriorly of the frame 31 to a position interiorly of frame 31 terminating in a circular opening to receive the first post therethrough to provide a generally planar support platform. It may be appreciated that the interior frame 30, the exterior frame 31, and the non-skid plate 32 form a square support surface for receiving individuals thereon and is rotated forty-five degrees relative to the flange plate 22, as illustrated in FIG. 5 for example. The forty-five degree rotation enables the use of the individual support rods to be positioned medially of each side of the square formed by the frames 30 and 31 with a minimum of angulation effected to the support rods 26 through 29.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A carousel apparatus, comprising, a first post including a lowermost terminal end secured to an anchor plate, and said first post telescopingly and adjustably received at its other end within a second post extending upwardly of said first post from a lower end of said second part, and a third post rotatably mounted within and upwardly of an upper end of said second post, and a flange plate horizontally secured to an upper end of said third post wherein said flange plate includes a pair of spaced parallel flanges extending upwardly of said flange plate including a first flange and a second flange, and a first support rod, a second support rod, a third support rod, and a fourth support rod secured to an upper surface of said flange plate, and lower ends of said support rods extend downwardly below said third post and said second post underlying and secured to a support plate for receiving individuals thereon.

2. A carousel apparatus as set forth in claim 1 wherein said anchor plate includes a pair of "C" shaped channels secured to an opposed pair of sides of said anchor plate for preventing tipping of said anchor plate when secured within a ground support surface.

3. A carousel apparatus as set forth in claim 2 wherein said first post includes a series of aligned first apertures extending through said first post and alignable with a series of second apertures extending through said second post, wherein said apertures in said first and second posts are alignable for receiving a plurality of securement pins therethrough to enable vertical adjustment of said second post relative to said first post.

4. A carousel apparatus as set forth in claim 3 wherein said second post includes an interiorly formed annular flange positioned below an upper terminal edge of said second post, and said third post includes a plurality of spaced bearings wherein a lowermost bearing is positioned upon said annular flange and wherein said upper bearing is positioned within said second post for rotatably mounting said third post relative to said second post, and further including a cap member of a diameter greater than that of said second post and receiving said third post and said bearings therewithin to provide protection of said bearings and interior surfaces of said first, second, and third posts preventing intrusion of foreign materials.

5. A carousel apparatus as set forth in claim 4 wherein said first and second flanges on said flange plate each include a single through-extending opening therethrough comprising a first opening extending through said first flange and a second opening extending through said second flange, and the first support rod includes an upper coextensive leg extending through said first opening and extending along a first edge of said flange plate between said first and second flanges, and the second support rod includes an upper coextensive leg secured to and extending along said second flange, and the third support rod includes an upper coextensive leg extending through said second opening adjacent a further edge parallel to and spaced from said first edge, and the fourth support rod includes an upper coextensive leg extending along said first flange adjacent thereto.

6. A carousel apparatus as set forth in claim 5 wherein said coextensive legs of said first, second, third, and fourth support rods are each formed with concave recessed ends for receiving orthogonally positioned support rods therewithin as the support rods are secured to the flange plate.

7. A carousel apparatus as set forth in claim 6 wherein lower terminal ends of said first, second, third, and fourth support rods include outwardly extending legs, and the outwardly extending legs underlie an inner tubular framework and an exterior tubular framework wherein said interior and exterior tubular frameworks are in horizontal alignment with one another and spaced relative to one another, and a non-skid planar plate is fixedly secured to upper portions of said interior and exterior tubular frames.

8. A carousel apparatus as set forth in claim 7 wherein said flange plate is of a square configuration, and said interior, exterior, and non-skid plate are of a square configuration, and the interior, exterior, and non-skid plate form a square support member, and the square member is rotated forty-five degrees relative to said flange plate to minimize angulation of the upper and lower legs of each respective support rod enhancing integrity and strength of the apparatus.

* * * * *